United States Patent [19]

Hummel

[11] Patent Number: 4,768,313

[45] Date of Patent: Sep. 6, 1988

[54] APPARATUS FOR MACHINING AN EARTH GRADER BLADE SUPPORT

[75] Inventor: Daniel L. Hummel, Longmont, Colo.

[73] Assignee: Flatiron Service Company, Boulder, Colo.

[21] Appl. No.: 33,225

[22] Filed: Apr. 2, 1987

[51] Int. Cl.[4] ..... B24B 19/00

[52] U.S. Cl. ..... 51/241 S; 51/241 B

[58] Field of Search ..... 51/241 R, 241 S, 241 B, 51/251, 241 VS, 241 A, 245; 409/179

[56] References Cited

U.S. PATENT DOCUMENTS 2,188,720 1/1940 McQuade ..... 51/241 B

*Primary Examiner*—Roscoe V. Parker

*Attorney, Agent, or Firm*—Cook, Wetzel & Egan, Ltd.

[57] ABSTRACT

An apparatus for simultaneously machining three circumferential surfaces of a circular workpiece. The device includes a frame having support for securing the workpiece thereto. A center tube rotatably supported by the frame extends into the interior of the circular workpiece and supports diametrically opposed spindle arms. One spindle arm supports a pair of rotatably grinding wheels disposed to grind parallel horizontal surfaces on the workpiece. The other spindle arm supports a rotatable grinding wheel for machining the interior radial surface of the workpiece. The position of the grinding wheels may be accurately controlled by dovetail slides and handwheels. The grinding wheels are rotated with respect to their spindle arms and the center tube is rotated so as to move the grinding wheels about the circumference of the workpiece to simultaneously machine each of the three surfaces of the workpiece.

5 Claims, 3 Drawing Sheets

APPARATUS FOR MACHINING AN EARTH GRADER BLADE SUPPORT

BACKGROUND OF THE DISCLOSURE

The present invention relates to a device for machining a large workpiece and, more particularly, to a device for machining the rotatable circle that supports the blade of an earth grader.

Earth graders typically support a blade that may be raised and lowered to adjust the depth of cut of the grading edge, and may be rotated about a vertical axis to adjust the angle of the grader edge with respect to the direction of travel of the grader, thus adjusting the width of the cut. The blade is mounted on a removeable, internally-toothed "circle", the teeth on the circle meshing with teeth on a rotatable turntable carried by the grader. The circle is typically made of cast metal and is on the order of 40 inches in diameter.

After a period of use, the teeth on the circle become worn and the circle, itself, worn outof round, permitting play of the circle with respect to the grader turntable, which greatly affects the accuracy with which the grader blade may be adjusted. Consequently, the teeth of the circle are periodically reconditioned to ensure a minimum of play and the greatest amount of grading accuracy.

To recondition the grader circle, the worn tooth segments are removed and new teeth are welded to the interior of the circle. After such welding, the upper and lower surfaces of the new teeth must be ground parallel to one another, and the interior surface of the circle machined to be concentric with the crest of the teeth and perpendicular to the upper and lower surfaces thereof. The accuracy of machining the reconditioned circle is critical to insure that the circle will rotate freely, with minimal play, when it is replaced on the grader and to permit precise adjustment of the grader blade.

While accurately machining large workpieces is typically a difficult procedure, the machining of the wear surfacs of the grader circle is further complicated because the welding of the teeth to the circle serves to further distort the geometry of the circle. Previously, grinding of the three wear surfaces has been a time consuming and difficult process because of both (1) the accuracy required, particularly to machine the parallel surfaces of the reconditioned teeth, and (2) the large size of the workpiece to be machined.

Accordingly, it is the principal object of the present invention to provide an apparatus that accurately machines the reconditioned circle of an earth grader.

A further object is to provide an apparatus that simultaneously machines the parallel surfaces of a circular workpiece.

More particularly, it is an object to provide an apparatus that quickly and accurately machines each of the three wear surfaces of a reconditioned grader circle.

It is an additional object to provide such a device that is simple to set up and operate.

These objects, as well as others that will become apparent upon reference to the accompanying drawings and following detailed description, are provided by an apparatus for machining a circular workpiece including a frame having support means for securing the workpiece to the frame. A center tube is rotatably supported by the frame so as to extend into the interior of the circular workpiece at substantially the center thereof so that a central axis defined by the tube is substantially perpendicular to a horizontal plane defined by the workpiece. The center tube supports diametrically opposed spindle arms, one spindle arm supporting a pair of rotatable grinding wheels at its outer end so that the grinding surfaces of such grinding wheels define planes substantially parallel to the plane defined by the workpiece. The other spindle arm supports a rotatable grinding wheel at its outer end that has its grinding surface defining a plane substantially perpendicular to the plane defined by the workpiece. Adjustment means is provided for moving the parallel grinding wheels in unison in a direction perpendicular to the plane defined by the workpiece, with a second adjustment means provided for adjusting the position of one of the parallel grinding wheels in such a direction. Adjustment means is also associated with the third grinding wheel for controlling the radial position thereof. The three grinding wheels are rotated with respect to their spindle arms and the center tube is rotated so as to move the grinding wheels about the circumference of the workpiece to simultaneously machine each of the three wear surfaces thereof. In a preferred embodiment, the grinding wheels are rotated by a series of rotatable shafts connected by drive belts, certain of the shafts being mounted eccentrically within rotatable bearing housings so that the drive belts may be adjustably tensioned by rotating the bearing housings.

DETAILED DESCRIPTION OF THE PREFERRED EMBODIMENT

Figure 1:
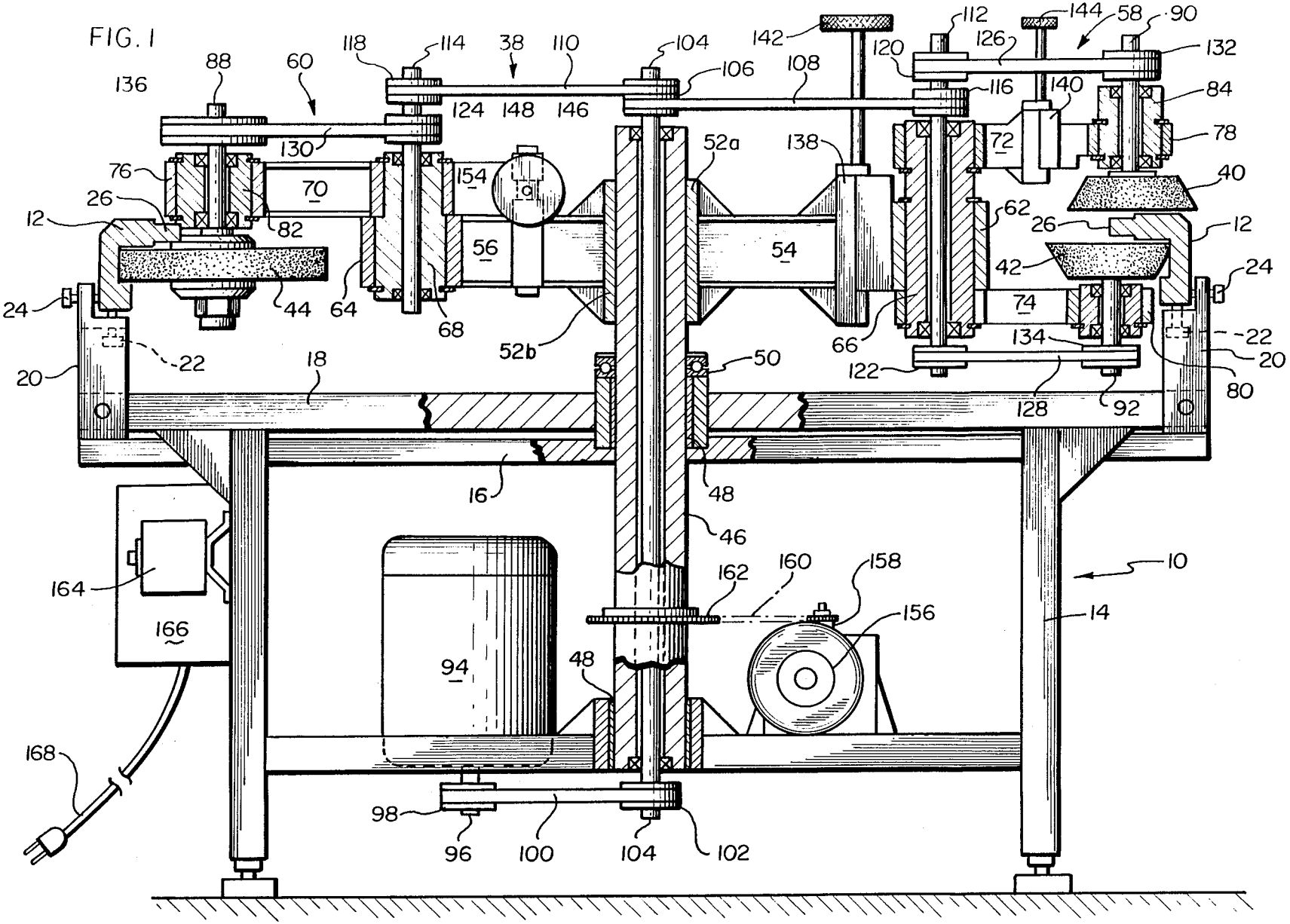
FIG. 1 is a cross-sectional view of a grinding apparatus embodying in the present invention.

Turning to the figures of the drawing, there is seen in FIG. 1 a device, generally indicated by 10, for machining a large, circular workpiece, such as a reconditioned earth grader circle 12. The device 10 includes a free-standing work table 14 having a generally-square table top 16 (best seen in FIG. 2) with a cross-frame 18 overlying the top thereof.

The cross-frame 18 includes upright members 20 at the radially-outer end of each frame member for supporting the grader circle 12. The upright members 20 may be carried by telescoping members (not shown) that are received within the individual members of the cross-frame 18 and may be adjusted outwardly to support workpieces of a larger diameter. Each upright member 20 includes two thumbscrews 22, 24 disposed in the vertical and horizontal planes, respectively, to permit leveling and centering of the grader circle 12 and to secure the grader circle 12 to the cross-frame 18.

Figure 3:
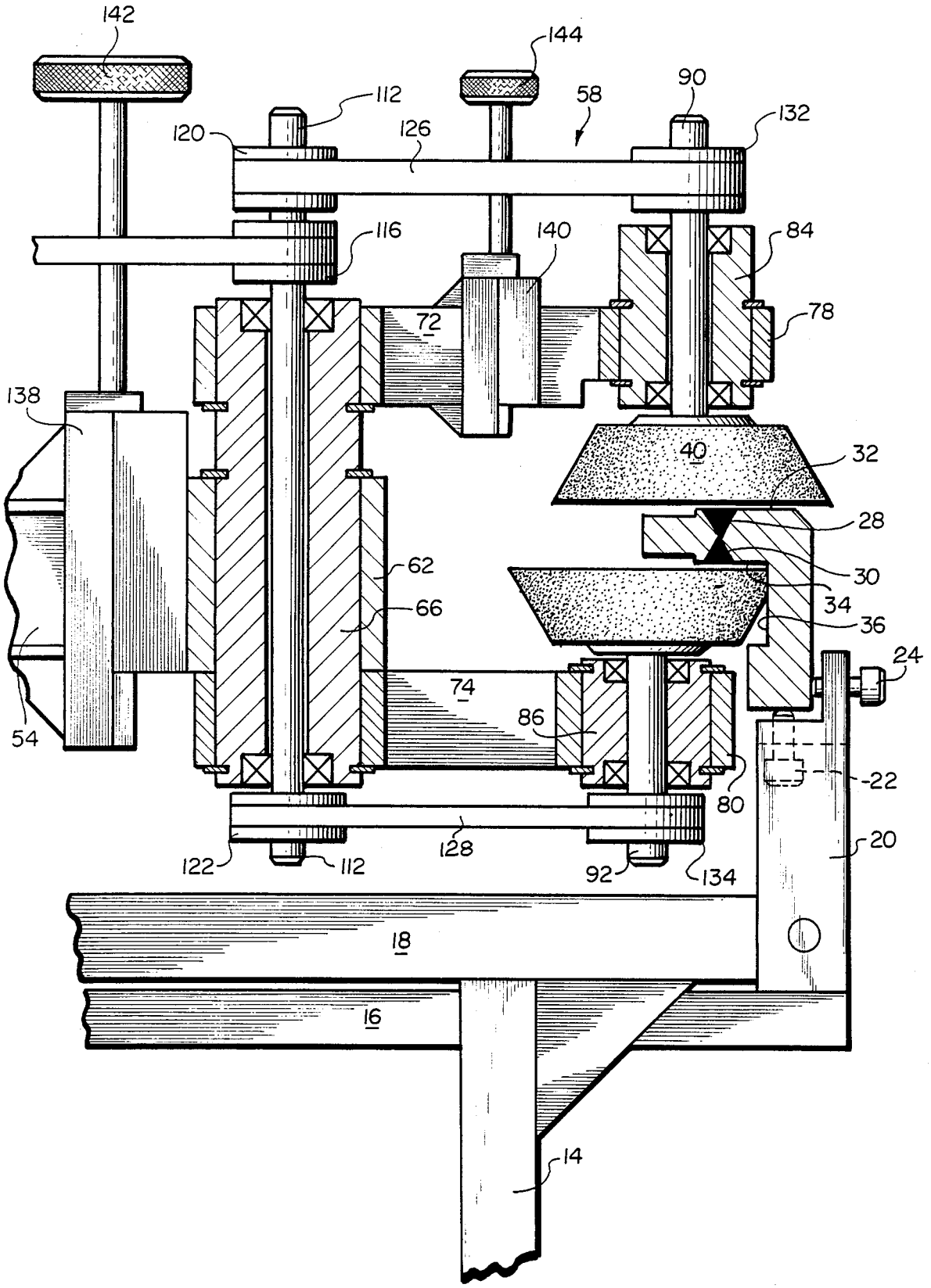
FIG. 3 is a view of a portion of the device of FIG. 1 enlarged for clarity.

As best seen in FIG. 3, a reconditioned grader circle 12 has replacement tooth segments 26 secured thereto by upper and lower welds 28, 30, the welding process resulting in weld deposits or beads on the upper and lower wear surfaces 32, 34 of the grader circle 12. After such replacement tooth segments 26 have been welded to the circle 12, the welds 28, 30 and the radial wear surface 36 of the grader circle 12 must be ground to permit the repositioning of the circle 12 on its associated earth grader. If the wear surfaces 32, 34, 36 of the circle are not true, i.e. with the surfaces 32 and 34 being parallel to each other and the surface 36 being concentric with the crests of the tooth segments 26 and perpendicular to the surfaces 32, 34, the accuracy with which the blade on the earth grader may be adjusted is reduced.

In accordance with the present invention, the work table 14 supports a rotatable grinding assemblage, generally indicated by 38, mounted interior of and concentric with the grader circle 12 (when one is supported by the work table 14.). The grinding assemblage 38 includes parallelly-disposed rotatable grinding wheels 40, 42 for machining, respectively, the upper and lower wear surfaces 32, 34 of the grader circle 12 and a radial rotatable grinding wheel 44 for machining the radial wear surface 36. Means is provided for rotating the grinding assemblage 38 with respect to the grader circle 12. Additionally, in order to adjust the depth of cut of the grinding wheels 40, 42, 44, means is provided for adjusting both the radial and vertical positions of the grinding wheels 40, 42 and for adjusting the radial position of the grinding wheel 44.

As best seen in FIG. 1, the grinding assemblage 38 is supported by a center tube 46 journaled in the work table 14 at the center thereof by tube bearings 48, with a thrust bearing 50 maintaining the vertical position of the center tube with respect to the work table 14 and cross frame 18. A two-part sleeve 52 is clamped to the upper end of the center tube 46 (the two halves, **52*a*, 52*b*, being best seen in FIG. 2), each half 52*a*, 52*b* having an I-beam section 54, 56 welded thereto and extending radially outward from the center tube 46. The parallel grinding wheels 40, 42 are supported by a spindle-arm structure 58 extending from the end of arm 54, while the radial grinding wheel 44 is supported by a spindle-arm structure 60 extending from the end of the arm 56**.

To support its respective spindle-arm structure 58, 60, each I-beam section 54, 56 terminates at its radially-outer end in a verticallyoriented cylindrical arm clamp 62, 64. Each cylindrical arm clamp 62, 64 supports a bearing housing 66, 68, respectively, that is rotatable with respect to its arm clamp. The bearing housing 68 carries a split bushing (not shown) and a single spindle arm 70 for rotatably supporting the radial grinding wheel 44, while bearing housing 66 carries two spindle-arms 72, 74 for rotatably supporting the upper and lower grinding wheels 40, 42, respectively. Each spindle-arm 70, 72, 74 terminates in a vertically-oriented tubular arm clamp 76, 78, 80 respectively, that supports a rotatable bearing housing 82, 84, 86, respectively. Journaled within the bearing housings 82, 84, 86, are spindles 88, 90, 92 which carry the grinding wheels 44, 40, 42, respectively.

To rotate the spindles 80, 90, 92 (and thus the grinding wheels 44, 40, 42) the device 10 includes a motor 94 (in practice, a three-phase, five horsepower motor) mounted to the work table 14. The drive shaft 96 of the motor 94 carries a driving pulley 98 which, through a double drive belt 100 and driven pulley 102, rotates a center shaft 104 journaled in the center tube 46. The upper end of the center shaft 104 supports a driving pulley 106 that carries a pair of double drive belts 108, 110. The drive belts 108, 110 rotate counter shafts 112, 114 journaled in the bearing housings 66, 68, and carrying driven pulleys 116, 118. The counter shaft 112 carries driving pulleys 120, 122 on its upper and lower ends, respectively, while the counter shaft 114 carries a single driving pulley 124. Drive belts 126, 128, 130 are carried by the pulleys 120, 122, 124 and connect these pulleys to driven pulleys 132, 134, 136 mounted on the spindles 90, 92, 88, respectively, to rotate their respective grinding wheels 40, 42, 44. (In practice, the device 10 is provided with guards overlying the drive belts 108, 110, 126, 128, 130 to ensure the safety of the operator. Such guards have been omitted in the illustrated device for clarity.) In the preferred embodiment, the counter shafts 112, 114 and spindles 88, 90, 92 are eccentrically mounted in their respective bearing housings 66, 68, and 82, 84, 86. Consequently, tensioning of the drive belts 108, 110, 126, 128, 130 may be accomplished by rotating the bearing housings within their respective arm clamps.

In keeping with another aspect of the invention, the positions of the grinding wheels 40, 42 are adjustable in their axial directions and the position of the grinding wheel 44 is adjustable in its radial direction to provide for precise machining of the wear surfaces 32, 34, 36 of the grader circle 12. To this end, the spindle arm structure 58 includes a pair of vertically-disposed dovetail slides 138, 140 operated by hand wheels 142, 144, respectively. As illustrated, the dovetail slide 138 is positioned on the I-beam section 54 between the center tube 46 and the cylindrical arm clamp 62 so that both grinding wheels 40, 42 can be moved in unison in a vertical direction by rotation of the hand wheel 142. The second tool slide 140 is positioned on the spindle arm 72 intermediate the bearing housing 66 and the tubular arm clamp 78 so that the distance between the grinding surfaces of the grinding wheels 40, 42 may be accurately adjusted. With this arrangement of the tool slides 138, 140, an equipment operator can first precisely position the lower grinding wheel 42 for machining the lower wear surface 34 of the grader circle 12 by adjustment of the hand wheel 142, and then position the upper grinding wheel 40 by adjustment of the hand wheel 144 so that the upper wear surface 32 may be ground simultaneously with the lower wear surface 34.

Figure 2:
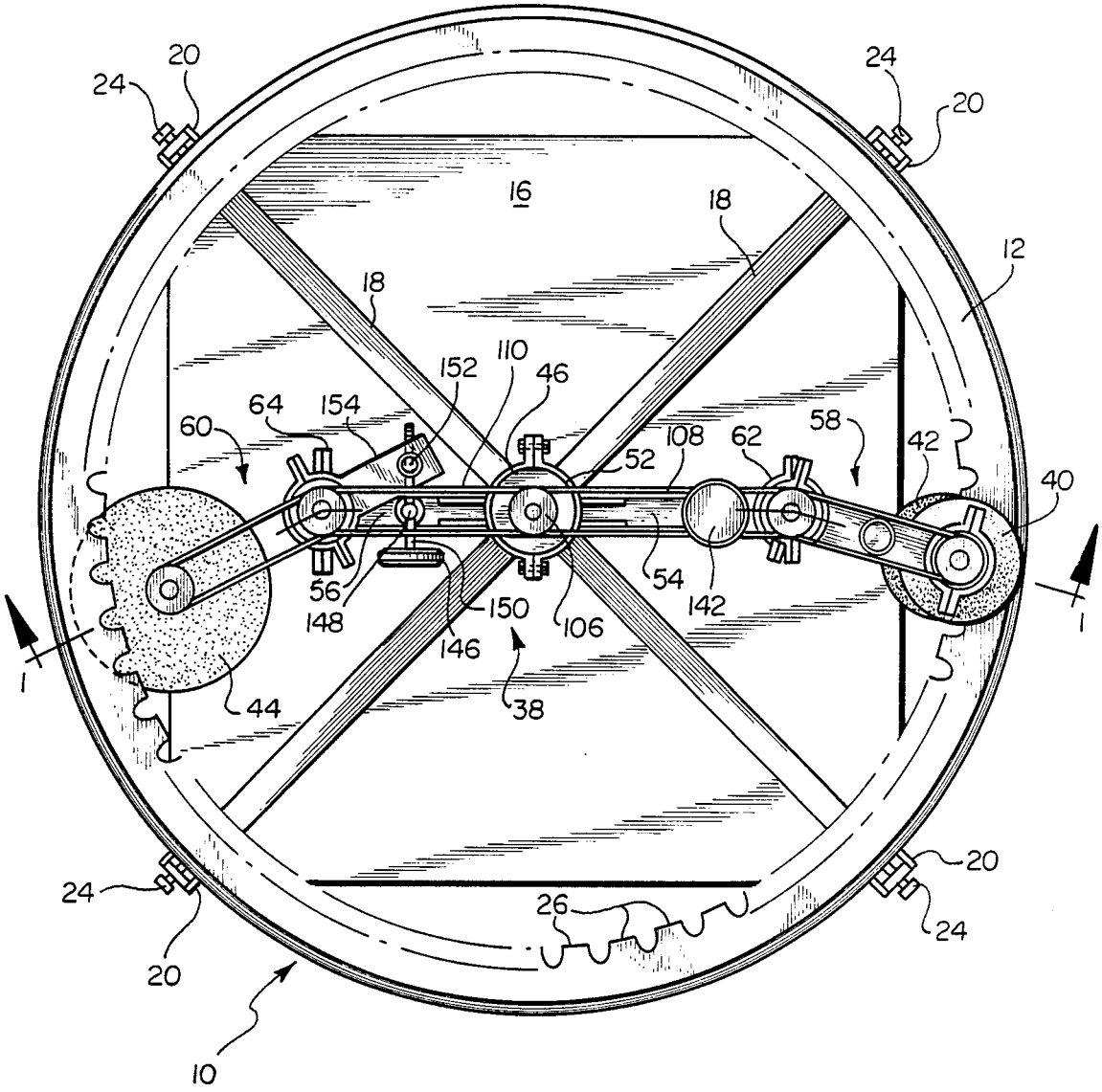
FIG. 2 is a top view of the grinding apparatus of FIG. 1.

To adjust the radial position of the grinding wheel 44, a horizontally-oriented hand wheel 146 is threadably received in an upright post 148 which, in turn, is pivotably-supported on the upper surface of the I-beam 56. As best seen in FIG. 2, the threaded shaft 150 of the hand wheel 146 is received in a vertically-oriented rotatable pin 152 supported by an extension 154 of the spindle-arm 70. Accordingly, the sindle-arm 70 may be rotated about its bearing housing 68—thus adjusting the radial position of the grinding wheel 44—by rotation of the hand wheel 146.

In accordance with another aspect of the invention, the three wear surfaces 32, 34, 36 may be simultaneously machined about their entire circumferential extent. To this end, the entire grinding assemblage 38 is rotated about a vertical axis coincident with the axes of the center tube 46 and center shaft 104 by means of a motor 156 (in practice a one-quarter horsepower, variable-speed DC motor) mounted to the work table 14 and directly coupled to a worm-drive reduction unit 158. A roller chain 160 operatively connects the worm-drive unit 158 to a sprocket 162 carried on the center tube 46 for rotating the same, and, consequently, rotating the entire grinding assemblage 38. In practice, the motor 156 is operated by a variable speed control 164, which has a separate 110V power supply, and is adjusted so that the grinding assemblage 38 will rotate at approximately 6–8 revolutions per minute. Power is supplied to the entire device 10 through a three-phase starter 166 and 220V power-supply cord 168. In operation, to facilitate placement of a reconditioned circle 12 on the upright support members 20 of the cross frame 18, the spindle arms 70, 72, 74 are first pivoted toward the center tube 46. After a grader circle 12 is placed on the work table 14, thumbscrews 22 are adjusted to level the circle, while thumbscrews 24 are adjusted to center the circle 12 with respect to the center tube 46. After proper location of the circle 12 on the work table 14, the spindle arms 70, 72, 74 are pivoted outwards toward their positions as shown in FIGS. 1, 2, and 3.

The vertical positions of the grinding wheels 40, 42 and the radial position of the grinding wheel 44 may be precisely adjusted by the handwheels 142, 144, 146 (as described above) to position the grinding wheels to within approximately 1/16th inch from the highest points of the weld deposits on the reconditioned wear surfaces 32, 34, 36. The motor 94 is then activated to rotate the grinding wheels 40, 42, 44 and the motor 156 is activated to rotate the grinding assemblage 38 about the center tube 46. With the grinding wheels 40, 42, 44 and the assemblage 38 all in motion, the handwheels 142, 144, 146 may all be adjusted to simultaneously grind the three wear surfaces 32, 34, 36 of the grader circle 12. After grinding is complete, the above steps are reversed to remove the grader circle 12 from the work table 14.

From the foregoing, it can be seen that a device for easily and accurately machining an earth grader circle has been provided that fully meets the objects of the instant invention. While the device has been described in terms of a preferred embodiment, there is no intent to limit the invention to the same. On the contrary, it is intended to cover all modifications and equivalents within the scope of the appended claims.

I claim as my invention:

1. An apparatus for machining a circular workpiece having an open, interior portion, comprising, in combination:

frame means;

support means for securing the workpiece to the frame means so that the workpiece defines a substantially horizontal plane;

center tube means rotatably supported by the frame means so as to extend into the interior of the circular workpiece at substantially the center thereof, a central axis defined by the center tube means being substantially perpendicular to the plane defined by the workpiece;

first and second spindle arms extending radially outwardly from the center tube means toward the workpiece and having radially outer ends;

first and second rotatable grinding wheels mounted to the first spindle arm at its outer end so that the grinding surfaces of the grinding wheels define planes substantially parallel to the plane defined by the workpiece;

first adjustment means associated with the first spindle arm for moving the first and second grinding wheels in unison in a direction perpendicular to the plane defined by the workpiece;

second adjustment means associated with the first spindle arm for adjusting the position of one of the first and second grinding wheels in a direction perpendicular to the plane defined by the circular workpiece;

a third rotatable grinding wheel mounted to the second spindle arm at its outer end so that its grinding surface defines a plane substantially perpendicular to the plane defined by the workpiece;

adjustment means associated with the second spindle arm for adjusting the radial position of the third grinding wheel;

means for rotating the first, second and third grinding wheels with respect to their respective spindle arms; and means for rotating the center tube means so as to move the grinding wheels about the circumference of the workpiece.

2. The device of claim 1 wherein the means for rotating the first, second and third grinding wheels further comprises:

a center shaft journaled within the center tube means;

a first counter shaft mounted within a first bearing housing on the first spindle arm intermediate the center tube means and the first and second grinding wheels; a second counter shaft mounted within a second bearing housing on the second spindle arm intermediate the center tube means and the third grinding wheel;

the first and second grinding wheels mounted on shafts journaled within third and fourth bearing housings supported at the outer end of the first spindle arm;

the third grinding wheel mounted on a shaft journaled within a fifth bearing housing at the outer end of the second spindle arm;

drive belt means operatively connecting the grinding wheel shafts to the first and second counter shafts;

drive belt means connecting the counter shafts to the center shaft; and means for rotating the center shaft.

3. The combination of claim 2 wherein the first and second counter shafts are mounted eccentrically within the first and second bearing housings and the grinding wheel shafts are mounted eccentrically within the third, fourth and fifth bearing housings so that the drive belts means may be adjustably tensioned by rotating the bearing housings.

4. The combination of claim 2 wherein the grinding wheels are pivotable with respect to the bearing housings mounting the counter shafts so that the grinding wheels may be pivoted inwardly toward the center tube means to facilitate placement and removal of the workpiece with respect to the support frame.

5. The combination of claim 2 wherein the first adjustment means is a dovetail slide mounted on the first spindle arm intermediate the center tube means and the first bearing housing and the second adjustment means is a dovetail slide mounted on the first spindle arm intermediate the first bearing housing and the third bearing housing.

* * * * *